US005131203A

United States Patent [19]

Pasquale

[11] Patent Number: 5,131,203

[45] Date of Patent: Jul. 21, 1992

[54] DAMPNESS-REMOVING CONSTITUENT UNIT FOR MASONRY SYSTEMS

[76] Inventor: Biahchi Pasquale, Via F. Di Palma N.89, 74100 Taranto, Italy

[21] Appl. No.: 603,612

[22] Filed: Oct. 26, 1990

[30] Foreign Application Priority Data

Oct. 27, 1989 [IT] Italy ..... 48491 A/89

[51] Int. Cl.[5] ..... E04B 5/04; E04C 2/04

[52] U.S. Cl. ..... 52/596; 52/600; 52/605; 52/612; 52/169.5

[58] Field of Search ..... 52/596, 600, 602, 603, 52/605, 606, 612, 792, 630, 169.5, 169.14

[56] References Cited

U.S. PATENT DOCUMENTS

| | | | |
|---|---|---|---|
| 3,475,529 | 10/1969 | Lacy | 52/602 |
| 4,411,121 | 10/1983 | Blacklin et al. | 52/792 |
| 4,640,854 | 2/1987 | Radtke | 52/596 |
| 4,730,953 | 3/1988 | Tarko | 52/169.5 |
| 4,800,697 | 1/1989 | Oswald | 52/630 |
| 4,943,185 | 7/1990 | McGuckin et al. | 52/169.5 |

*Primary Examiner*—David A. Scherbel
*Assistant Examiner*—Kien Nguyen
*Attorney, Agent, or Firm*—Pollock, Vande Sande & Priddy

[57] ABSTRACT

A dampness-removing constituent unit for masonry systems, which is intended both for reclamation and for the prevention of dampness formation, in particular of rising dampness. The unit is made up of brick, tile or concrete, and consists, in succession from its upper surface, of a first layer of homogeneous brick or tile material, a layer of resin material, a second layer of brick or tile material and having a continuous top portion and a lower portion in which alternate longitudinal holes are provided which have in their upper portion longitudinal metallic bars (inserted into the constituent unit or connected to the same by supporting members) which are intended for priming the electroosmotic phenomenon.

3 Claims, 5 Drawing Sheets

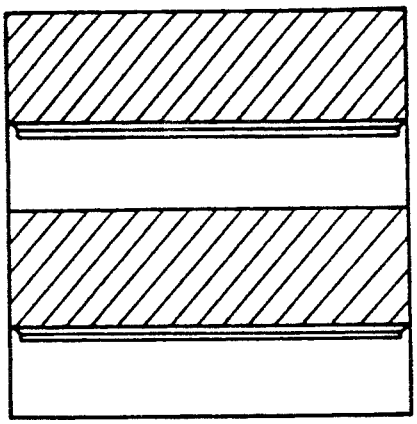
FIG. 4A
FIG. 4B
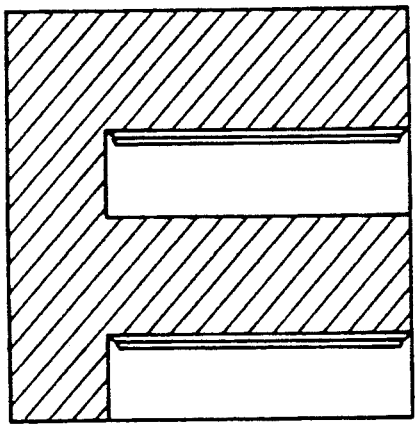
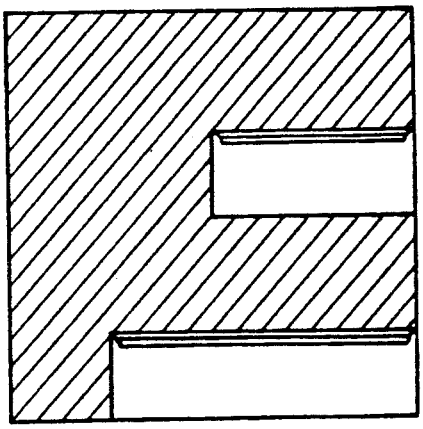
FIG. 4C
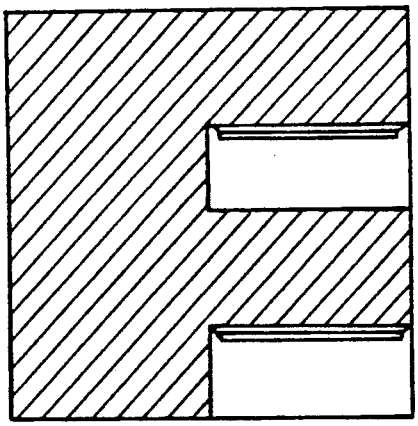
FIG. 4D

DAMPNESS-REMOVING CONSTITUENT UNIT FOR MASONRY SYSTEMS

FIELD OF THE INVENTION

This invention relates to a dampness-removing constituent unit for masonry systems both for reclaiming masonries and for prevention of dampness formation in newly built masonries.

The invention is more particularly intended for solving problems caused by capillary rising dampness, which differs from dampness caused by rain or condensation, and in a particular way both for physical and chemical type effects arising in the masonry itself.

BACKGROUND OF THE INVENTION

As is well known, the rising dampness level depends on the degree of compactness and of priming absorption of the material.

Various and different techniques have been adopted to date to counteract the negative effects of dampness in masonries and to prevent its formation.

One of these techniques is the so-called "wall-partition method". This involves the insertion of resins or of metallic plates, and consists in the creation of a barrier which prevents water from ascending.

Such method, though theoretically safe as regards the problem of capillary rising, also has considerable drawbacks which are due in particular to the method employed for installation.

Indeed, it is difficult to check whether the arrangement of the resin inserts has been carried out in the best way by means of well connected and welded joints, so as to assure the homogeneity of the masonry.

Moreover, metal oxidation in case of metallic plates, or resin depolymerization through the action of atmospheric agents, often cause rupture or cracking of the material in contact with water so as to damage its functional properties.

Finally, when the resin layers are placed in direct contact with the masonry, shrinkage and differential expansion with respect to the masonry itself often cause breaking crumbling of the masonry material and/or of the dampness-removing material employed.

Even in systems in which the resin is injected under pressure or by a slow transfusion, as in the Peter Cox method, depolymerization of the materials often occurs.

Moreover, both in the method of injection under pressure and in the method of slow transfusion the material. There may be incomplete filling with such materials or, in the case of the first-mentioned method, rupture of the capillary tubes with the consequent formation of pits of larger sizes, in which a larger amount of water becomes concentrated.

Another prior art technique for limiting dampness rising up the capillary tubes is the electro-osmosis method, which consists in creating an electric polarity inversion between the soil and the masonry, so as to invert also the path of the water particles and to direct them from the masonry itself towards the soil.

This is generally done by inserting copper electrodes into the masonry.

One of the greatest drawbacks of such system is due to the oxidation of the metallic members which if positioned improperly, damage the operating properties of the system.

The removal and exhaustion of dampness from masonries by the latter technique also requires a particularly long time and, as a consequence, often fails to produce the desired effects. Moreover, it works only with strong dampness concentrations, and stops when the percentage of the dampness diffused in a masonry is still too high for the wall to be accepted as hygienically suitable.

The use of siphoning devices, and in particular of the Knapen method, has the drawback of making reference to a member which is so inserted into the masonry as to cause the hole in the masonry itself not to be in direct contact with air. Moreover, it is inserted at such a slope as to perform its effectively only under certain atmospheric conditions.

Although the technique discussed hereinabove, like other techniques already known in the prior art, seen in theory to be efficient for reclamation and prevention of dampness formation in masonry structures, they are quite limited in paractice, because they all consist in interventions which are carried out directly on the masonry.

Moreover, taking into consideration the specific character of the installation systems, it is often impossible to perform a reclamation intervention by combining the effects of different methods.

Accordingly, there is an evident need for a dampness removing system endowed with a high degree of adaptation to the various masonry systems, which system should allow a rapid exhaustion of dampness, and should be easily usable both for reclamation interventions and in new buildings for prevention purposes; such system should also remove all installation problems typical of the methods described above and all functional drawbacks connected to such methods.

SUMMARY OF THE INVENTION

In order to meet such requirements, the present invention suggests a reclamation and prevention method against dampness, which method makes use of a masonry constituent unit derived (as regards its conformation) from the baked brick, which unit has morphological and functional properties that allow, together with the other adjacent constituent parts, a homogeneous barrier to be created, by means of which the formation of dampness can be obviated through the employment of both electroosmosis and thickness-decrease, as well as through aeration, siphoning and resin insertion, the latter being applied simultaneously with the formation of the constituent unit made up of a lattice grid or a resin plate.

Moreover, again according to the present invention, the realization is suggested of a building constituent unit which, in addition to performing the reclamation function, can also perform an aesthetic function in masonries in which it is inserted.

More particularly, the dampness-removing modular constituent unit of this invention exerts its dampness-removing function due to the presence of resins which are introduced in such article at the moment of formation of the same, such resins being distributed throughout the article in a homogeneous way, as well as to the contribution of the electroosmotic process that occurs owing to the presence of metallic members arranged in the portion of the constituent unit itself that shows a higher dampness density, to the presence of holes which are similar to siphons inside which a circulation of air streams occurs (with respect to a neutral axis), and to the decrease in the contact surface between the basis of the masonry and that of said constituent unit.

Again according to the present invention, provision is made so that, thanks to the arrangement of the resin layer inside each component, the barrier against the capillary rising which is so formed has some points of discontinuity which allow the residual dampness amounts that can be exhausted by evaporation to pass, thereby avoiding the danger of stagnation in the masonry portion below the barrier itself.

Moreover, again according to the present invention, the particular arrangement of the metallic members in the upper portion of the aeration holes, which arrangement is connected to the possibility of causing hot air streams to circulate through the holes themselves, favors the removal of water particles under strong dampness conditions.

Accordingly, a specific object of the present invention is a dampness-removing constituent unit which is made up of a compact material such as or tile or concrete, to be employed in masonry structures for reclamation interventions, or for prevention of dampness formation, said consitituent unit comprising in succession from the upper to the lower surface, a first brick or tile layer, a second brick or tile layer, said second layer having a continuous upper portion and a lower portion in which a number of alternate longitudinal holes are provided, having in their upper portion some support members or holes or any other particular means, wherein a number of bar-shaped longitudinal metallic members are fastened to said support members, and wherein said resin material layer is positioned between said first and said second layers so as to cover just the central portion and to leave the peripheral edges of said first layer of brick or tile in contact with those of said second layer so as to maintain the homogeneity of the masonry itself.

According to a preferred embodiment of the invention, the dampness-removing constituent unit may also have a third homogeneous, brick or tile layer, a second resin layer and a fourth layer of brick or tile provided with longitudinal holes, at a position below said second brick or tile layer.

Advantageously, again according to this invention, said holes provided in said second and in said fourth longitudinal layer have cross sections in the shape of an Ω, of a triangle, of a trapezium, or of a square, depending an aesthetic requirement.

Advantageously such holes, in addition to allowing metallic bars intended for favoring the electroosmotic phenomenon to be fastened through hooks, also favor the evaporation phenomenon by aeration or ventilation down to the innermost layer of the masonry itself.

As the capillary tubes of a masonry behave like a water pipe, an increase in the rising speed occurs simultaneously with a pressure drop and a strong lateral friction on the walls, with some deposition of salts and a decrease in the cross section of the capillary tube so as to stop or to slow down the rising of water.

Moreover, the particular morphological configuration of the constituent unit causes a decrease in the thickness of the contact area with the liquid stream and hence of the zone in which the absorption occurs; accordingly, depending on the different masonry thicknesses, preferably a number of longitudinal through-holes are provided whose length is equal to one-half the longitudinal size of the brick.

In another embodiment of the invention, the constituent unit is provided on its inner side with insulating material, which may be of the thermoacoustic type, and which is not provided with holes.

Moreover, again according to this invention, the dampness-removing constituent unit is made up of brick or tiles material or of concrete so that a uniform porosity is kept throughout the masonry.

Finally, said resin layer arranged between first and said second layers is made up of a lattice grid or of a resin or polymer layer, such layer being inserted after baking the brick which is divided into two parts when it is molded, which parts are then joined by means of an adhesive agent. (The resin can be inserted into the concrete constituent unit already after pouring the mixture into the mold, because there is no successive baking).

The resin grid may be introduced by imbibition or by absorption-impregnation, and arranged within the article or at a position close to the surface of the same.

BRIEF DESCRIPTION OF THE DRAWINGS

This invention will be now disclosed just for illustrative and not for limitative purposes with reference to the enclosed drawings, wherein:

FIGS. 4A, 4B, 4C and 4D are vertical cross-sectional views of the side portion of the dampness-removing constituent unit according to the invention, of the double type.

DESCRIPTION OF PREFERRED EMBODIMENT

Figure 1:
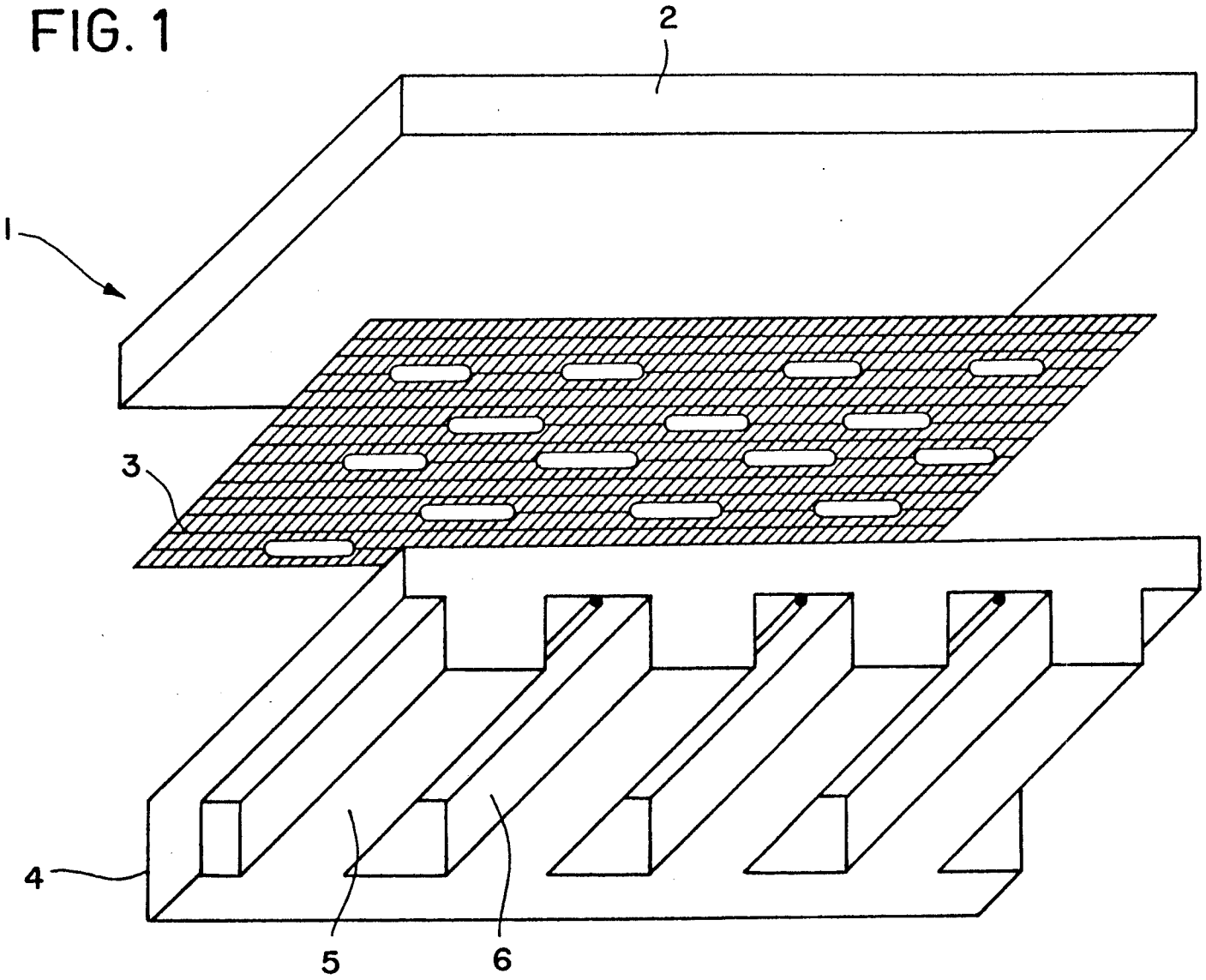
FIG. 1 is an exploded axonometric view of the dampness-removing constituent according to the invention without the metallic members in the lower part of the holes.
Figure 2A:
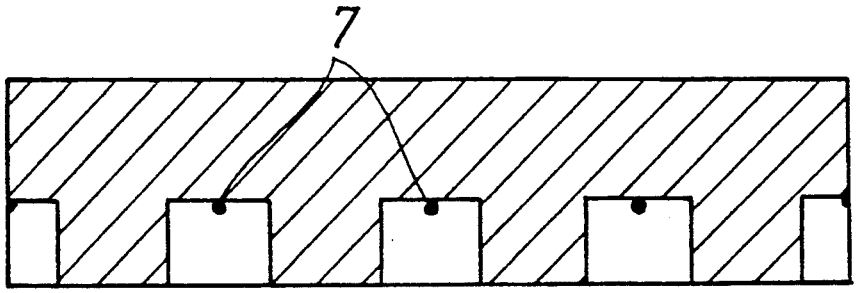
FIGS. 2A, 2B, 2C and 2D are front cross-sectional schematic views of the dampness-removing constituent unit according to the invention, with various cross-sectional shapes of the longitudinal holes.
Figure 2B:
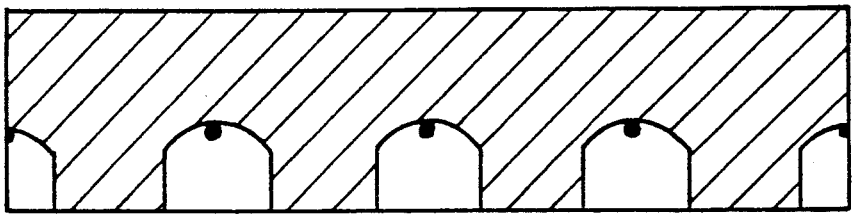
Figure 2C:
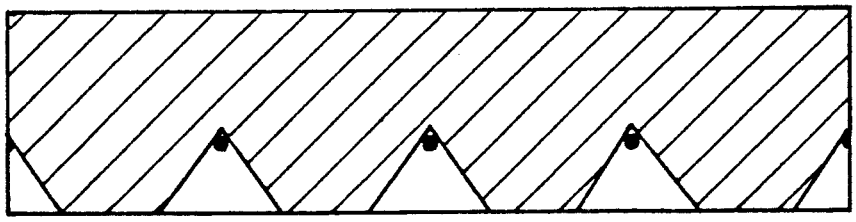
Figure 2D:
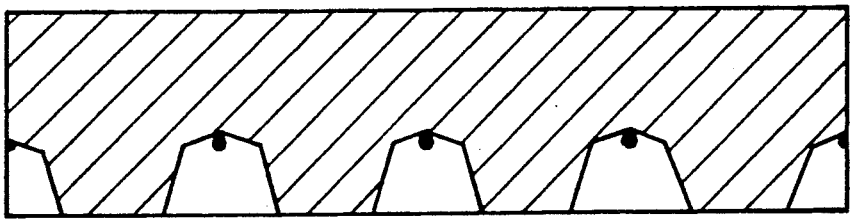

As shown in FIG. 1, the dampness-removing constituent unit 1 comprises three layers: a first, brick of tile layer 2, a layer 3 which is constituted by a resin grid, and a brick or tile.

Layers 2 and 4 are next connected by means of solidifying materials after interposing the grid or resin layer 3 is interposed.

This last layer has a smaller surface area than the lower surface of layer 2 and the upper surface of layer 4, so that the edges of the two concrete layers turn come into direct contact.

The lower layer 4 rests directly on the masonry at the points corresponding to the portions 5 of the spacing members delimiting the longitudinal grooves 6.

A small support tooth (not shown in FIG. 1) is provided in the upper portion of each of said spacing members, a metallic longitudinal member 7 being connected to said small tooth, said metallic member creating together with the soil the electric field through which the migration of the water particles from said masonry to the soil occurs.

The cross section of the longitudinal grooves 6, as shown in FIGS. 2A, 2B, 2C, 2D, can be of different types depending on the type of masonry kind and on the aesthetic effect to be obtained. However, the volume of such grooves is substantially similar in each of the embodiments illustrated in FIGS. 2A–2D.

Figure 3A:
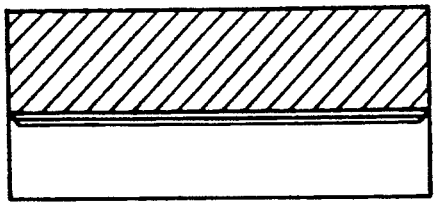
FIGS. 3A, 3B and 3C are vertical cross-sectional views of the side portion of the dampness-removing constituent unit according to the invention.
Figure 3B:
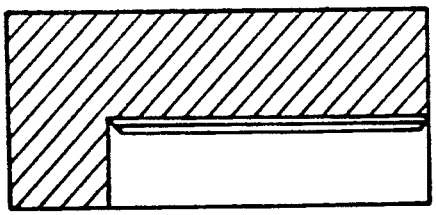
Figure 3C:
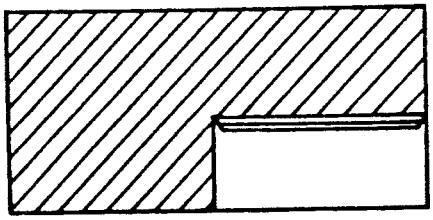
Figure 5A:
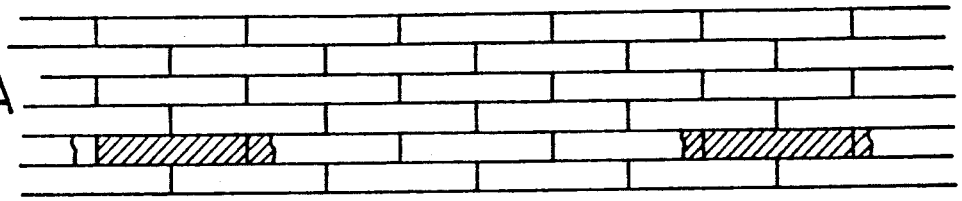
FIGS. 5A, 5B, 5C and 5D show a front schematic views of various different installation systems of the constituent unit B65 according to the invention.
Figure 5B:
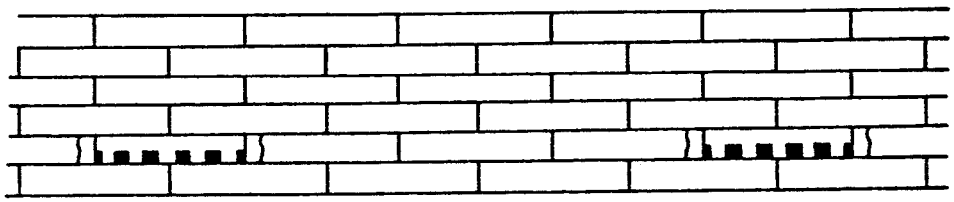
Figure 5C:
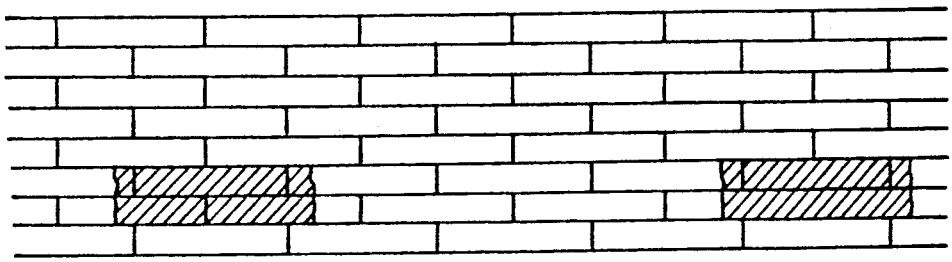
Figure 5D:
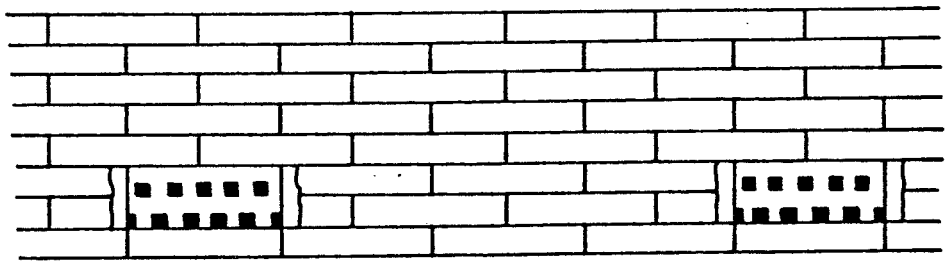

FIGS. 3A, 3B and 3C illustrate on the contrary a vertical cross section side view of the dampness-removing constituent unit, in which view it can be seen that the longitudinal grooves 6 may extend through the entire modular member (FIG. 3A), or just partially (FIGS. 3B and 3C). The grooves at each end of lower layer 4 are only one-half as wide as the central grooves, so as to form a full-width groove jointly with the half-width end groove of an adjacent lower layer.

FIGS. 4A, 4B, 4C and 4D further embodiments of the dampness-removing constituent unit, such embodiments being made up of four overlapped layers of brick or tile, in which grooves to have different longitudinal extents.

Finally, FIGS. 5A, 5B, 5C and 5D illustrate different kinds of positioning and arrangements of the constituent unit 1 in a masonry, respectively for performing the function of a simple and of a double wall-partition system.

The grooves may have different sizes, reciprocal spacings which may even be considerable, compatible with the static strength and with the degree of dampness-removing power of the member itself.

The constituent unit may be formed with or without the metallic members, either with or without a resin, and with or without visible holes and possibly with layers of an insulating material.

I claim:

1. A brick-shaped composite unit for preventing dampness formation in masonry structures, said unit comprising:

(a) a first substantially parallelepiped element of tile material having flat rectangular upper and lower surfaces;

(b) a second, substantially rectangular thin waterproof element having a surface area small than a surface area of said first element; and (c) a third, substantially parallelepiped element of tile material having a flat rectangular upper surface corresponding to that of said first element and a grooved surface with parallel grooves of predetermined cross-section disposed on one side of said third element, said grooves having a first, open end and a second, closed end;

(d) partition walls separating said grooves and each having a flat lower surface forming an abutment surface of said composite unit;

(e) a metallic element extending through an entire length of each said groove and fastened onto an upper surface of each respective groove;

(f) said lower surface of said first element being rigidly connected to said upper surface of said third element by means of a solidifying material with a central sandwich-like interposition of said second element, said solidifying material filling marginal portions of connected surfaces of said first and third elements not covered by said second element so as to form a homogeneous brick-shaped unit;

(g) whereby said grooves receive capillary dampness from all sides owing to said waterproof second element, and discharge said dampness by electroosmosis caused by said element and by evaporation thereof due to aeration of said grooves.

2. A brick-shaped composite unit as claimed in claim 1, wherein said grooves include central grooves and marginal grooves, said marginal grooves having substantially one-half the width of said central grooves and an open outer side, so as to form a full-width groove jointly with the half-width groove of an adjacent composite element.

3. A brick-shaped composite unit as claimed in claim 1, wherein said second element is a resin grid.

* * * * *